US006923118B2

(12) United States Patent
Patzelt

(10) Patent No.: US 6,923,118 B2
(45) Date of Patent: Aug. 2, 2005

(54) DRIVE FOR IMPRESSION CYLINDERS OF A ROTARY PRESS

(75) Inventor: Stephan Patzelt, Plauen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 160 days.

(21) Appl. No.: 10/625,213

(22) Filed: Jul. 23, 2003

(65) Prior Publication Data

US 2004/0123756 A1 Jul. 1, 2004

(30) Foreign Application Priority Data

Jul. 23, 2002 (DE) ..... 102 33 261

(51) Int. Cl.[7] ..... B41F 7/02; B41F 13/24
(52) U.S. Cl. ..... 101/218; 101/185; 101/247
(58) Field of Search ..... 101/218, 247, 101/216, 375, 217, 143–145, 182, 184, 185, 192

(56) References Cited

U.S. PATENT DOCUMENTS 3,785,287 A * 1/1974 Dahlgren ..... 101/247
4,072,104 A * 2/1978 Schaffer ..... 101/248
4,098,185 A * 7/1978 Davidson, Jr. ..... 101/137
4,240,346 A * 12/1980 Landis et al. ..... 101/139
4,281,595 A * 8/1981 Fujishiro ..... 101/177
4,362,098 A * 12/1982 Stelling, Jr. et al. ..... 101/219
4,442,773 A * 4/1984 Kobayashi ..... 101/177
4,643,090 A * 2/1987 McKrell et al. ..... 101/218
4,932,321 A * 6/1990 Hermach ..... 101/211
5,161,463 A * 11/1992 Knauer et al. ..... 101/220
5,235,910 A * 8/1993 Tafel ..... 101/218
5,311,817 A * 5/1994 Funada ..... 101/177
5,722,323 A * 3/1998 Whiting et al. ..... 101/218
6,216,592 B1 4/2001 Knauer et al.

FOREIGN PATENT DOCUMENTS

DE 197 46 108 A1 4/1999

* cited by examiner

*Primary Examiner*—Eugene H. Eickholt
(74) *Attorney, Agent, or Firm*—Cohen, Pontani, Lieberman & Pavane

(57) ABSTRACT

Apparatus for preventing the cylinder drive wheels of the transfer cylinders jamming against one another during setting and throwing-off movements includes a transfer cylinder having cylinder drive wheel which engages the drive wheels of a forme cylinder and of an impression cylinder in the thrown-on position. A linkage is connected to the transfer cylinder to be moved into the thrown-off position so that synchronously with the pivoting of the transfer cylinder to be thrown off, a counter-rotation of the transfer cylinder is produced a gear-wheel chain which meshes with the drive gear wheels of the forme cylinder and of the impression cylinder.

12 Claims, 1 Drawing Sheet

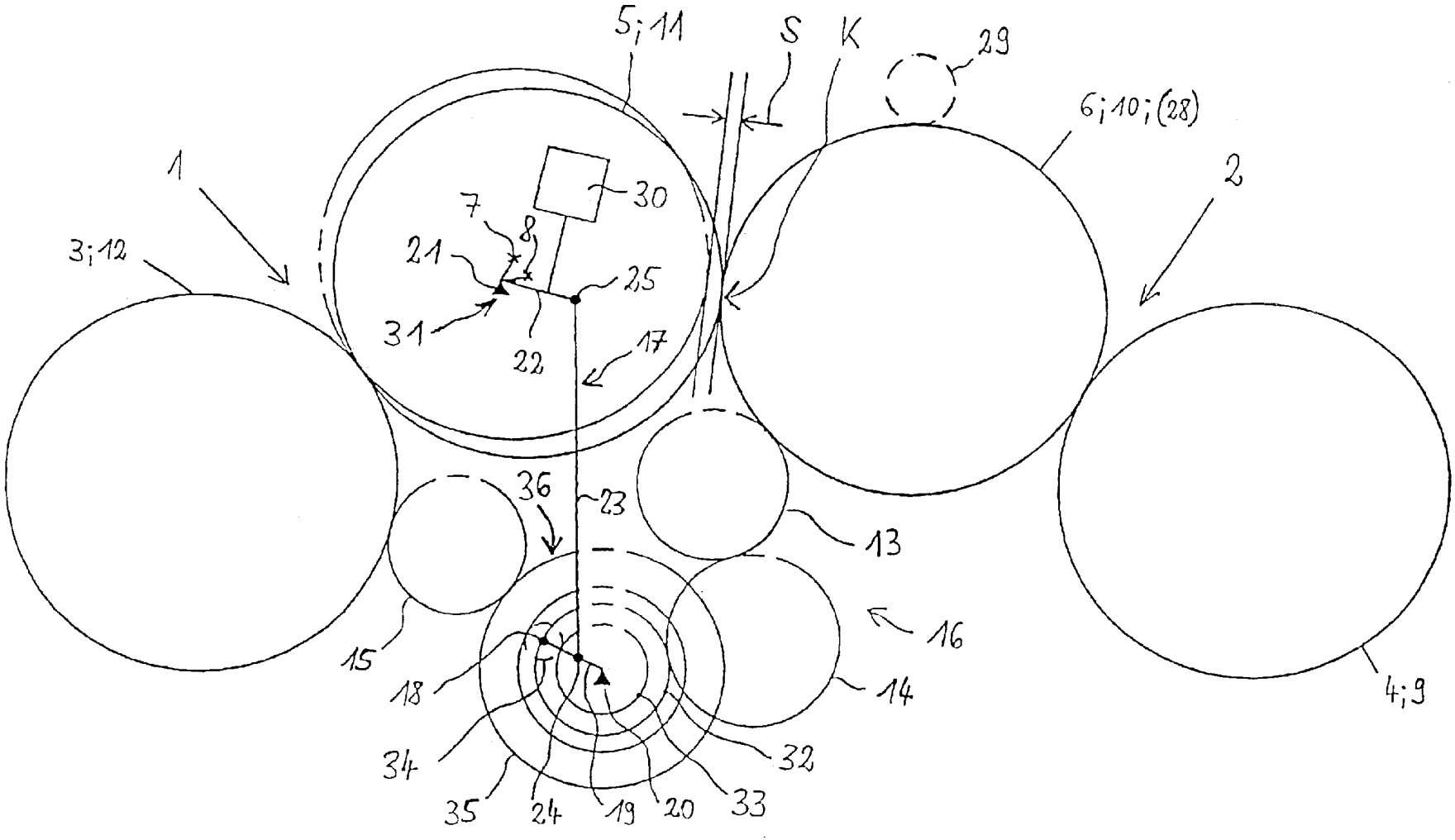
4;9
2
6;10;(28)
29
K
S
5;11
30
25
17
7
8
22
21
31
23
36
13
16
14
32
33
20
19
24
35
34
18
15
1
3;12

DRIVE FOR IMPRESSION CYLINDERS OF A ROTARY PRESS

BACKGROUND OF THE INVENTION

1. Field of the Invention

The invention relates to an apparatus for setting and throwing off a transfer cylinder where, in the thrown-on position, the drive wheel of the transfer cylinder is engaged with the drive wheel of an impression cylinder, the drive wheel of the transfer cylinder further engaging the drive wheel of a forme cylinder.

2. Description of the Related Art

In DE 197 46 108 A1, a drive for impression cylinders of a rotary press is disclosed, in which all the impression cylinders are driven by a drive. The disadvantage of such a drive is that the cylinder drive wheels of the transfer cylinders can jam against one another during setting and throwing-off movements.

SUMMARY OF THE INVENTION

The present invention is based on the object of providing an apparatus which prevents the cylinder drive wheel of the transfer cylinder jamming against the drive wheel of the impression cylinder during setting and throwing-off movements.

According to the invention, this object is achieved by a gear wheel chain which meshes with the drive wheels of the forme cylinder and the impression cylinder, and a transfer element connecting the transfer cylinder to the gear wheel chain so that the gear wheel chain produces a counter-rotation in the transfer cylinder synchronously with the pivoting of the transfer cylinder to a thrown-off position.

A significant advantage of the present invention is that the bridge drive can be retained and therefore no additional motors are required for driving the printing unit during the throwing-off operation.

It is significant that exact mechanical and in-register re-coupling of the pivotable transfer cylinder or the cylinder drive wheels is achieved with the drive according to the invention.

Furthermore, a high degree of fault protection is ensured with this drive, as only mechanical components are used. In addition, no additional actuating drives, and thus no additional controllers, are necessary.

A significant advantage of the invention is that the transfer cylinder or pair of impression cylinders pivoted to form a printing gap are driven by means of a gear-wheel chain which includes at least one planetary gear mechanism, also referred to as a planet gear mechanism or variable-ratio gear mechanism.

It is significant that transferring the torque via planetary gear mechanisms ensures constant meshing which is optimal in all operating states.

A further special feature is that the pivoting lever, acting as an eccentric, of the planetary wheel, also called the epicyclic wheel, is connected via a coupler to the eccentric bearing ring of the transfer cylinder. Synchronous pivoting of the transfer cylinder and of the eccentrically mounted planetary wheel is thus achieved.

It is significant that a movement rotating in the opposite direction to the rotation of the transfer cylinder is produced by this planetary wheel which can be pivoted synchronously with the transfer cylinder, in order that the cylinder drive wheels, meshing mutually in the thrown-on position, of the two transfer cylinders can disengage when one transfer cylinder is being pivoted into the thrown-off position and thus only after this is the pivoting into the thrown-off position made possible.

The counter-rotational movement has the effect that the mutually meshing cylinder drive wheels do not build up tension between them when the transfer cylinder is being pivoted, but rather the tooth flanks of the cylinder drive wheels lie movably, i.e. without mutual tensioning, against one another within the toothing until the meshing is finally interrupted.

An important aspect during this is that the printing gap is larger than the tooth height of the individual cylinder drive wheels and thus in the printing gap position the toothing is completely disengaged between the cylinder drive wheels for the purpose of throwing off.

Advantageously, the drive according to the invention should already be used when the printing gap is larger than 25% of the tooth height of the cylinder drive wheels which can be moved apart from one another into the thrown-off position.

The pivoting lever, acting as an eccentric, of the planetary wheel is advantageously configured as a long pivoting lever, the pivoting of the planetary wheel approximately corresponding to a displacement along a straight line so it is possible to achieve a minimized tooth play or a minimized tooth spacing between the individual gear wheels.

It is advantageous that, when the eccentric bearing ring is rotated from the thrown-on position into the thrown-off position and also vice versa, this rotation takes place within the toothing of the cylinder drive wheels, of the intermediate wheels, and of the gear wheels of the planetary gear mechanism.

A significant advantage of the present invention is that the toothing of an intermediate wheel and/or of a gear wheel of the planetary gear mechanism is configured with such play that, in normal operating engagement, i.e. when all four impression cylinders are in engagement with one another, the flanks of this intermediate wheel or gear wheel of the planetary gear mechanism do not come into contact with a further intermediate wheel, gear wheel of the planetary gear mechanism, and/or with a cylinder drive wheel. Thus, on account of the flank contact being interrupted, there is no transmission of force between the cylinder drive wheel and the intermediate wheel or the gear-wheel chain with planetary gear mechanism, and there is therefore no wear.

In normal operating engagement, force is transmitted only via the cylinder drive wheels.

It should be mentioned that the planetary wheel and drive wheel of the pivotable transfer cylinder can be coupled directly or indirectly with the aid of a drive, for example a motor or a pressure medium operated operating cylinder.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWING

The sole FIGURE is a schematic view of a printing unit according to the invention, the two ink-transferring pairs of cylinders of which have a drive connection directly via the cylinder drive wheels in the thrown-on position, and have a drive connection via an additional gear-wheel chain in the thrown-off position.

DETAILED DESCRIPTION OF THE PRESENTLY PREFERRED EMBODIMENTS

The FIGURE shows a double printing unit equipped with two ink-carrying pairs of impression cylinders 1; 2. Each pair of impression cylinders 1; 2 has an outer forme cylinder 3; 4 and an inner transfer cylinder 5; 6. In the thrown-off position 7 (represented as a dashed circle) of the left-hand transfer cylinder 5, the cylinder 5 is pivoted away from the right-hand transfer cylinder 6, arranged fixed in position, forming a printing gap S, for example for a printing-material web passing between the two cylinders 5; 6 without contact. The transfer cylinder 5 can be pivoted into a thrown-on position 8 which is represented as a solid circle and forms a press nip K with the right-hand transfer cylinder 6, for example in order to apply ink to both sides of the printing-material web.

A cylinder drive wheel 9; 10; 11; 12 is attached in each case to the journal of an impression cylinder 3; 4; 5; 6 (not shown in greater detail).

The cylinder drive wheel 10 of the right-hand transfer cylinder 6, which cannot be pivoted, is in engagement with the cylinder drive wheel 12 of the left-hand forme cylinder 3 via a gear-wheel chain 16 including intermediate wheels 13; 14; 15 and a planetary gear mechanism 36 during the pivoting-in and pivoting-away movements of the transfer cylinder 5. The pivotable left-hand forme cylinder 3 is thus in engagement with the transfer cylinder 5 when the transfer cylinder 5 is pivoted into the thrown-off position 7, and is not pivoted away from the transfer cylinder 5.

The intermediate wheel 14 is in engagement with a gear wheel 32 of the planetary gear mechanism 36. The gear wheel 32 is connected to a central wheel 33, at least one planetary wheel 34 running around the central wheel 33. Up to three planetary wheels 34 are preferably to be used. The planetary wheel 34 is mounted, by means of a web configured as a pivoting lever 19, on a stationary pivot point 20, for example the central axis of the central wheel 33 or the central axis of the planetary gear mechanism 36. The planetary wheel 34 can be brought into engagement with a gear wheel 35, it being possible to drive the intermediate wheel 15 by means of the gear wheel 35.

The individual gear wheels 32 to 35 of the planetary gear mechanism 36 are dimensioned in such a way that the planetary gear mechanism 36 does not affect the gear ratio.

The double printing unit is driven, for example, by means of the right-hand stationary intermediate wheel 13 which is fastened to a shaft (not shown in greater detail) of a motor.

The pivotable transfer cylinder 5 and the pivotable planetary wheel 34 are connected via a linkage 17. In this way, synchronous pivoting of the transfer cylinder 5 and of the planetary wheel 34 is achieved. In this case, the linkage 17, by means of which the pivoting movements, proceeding synchronously with respect to each other, of the left-hand transfer cylinder 5 and of the eccentrically mounted planetary wheel 34 can be carried out, is actuated by a control gear 31 (only represented schematically as an arrow). The control gear moves the transfer cylinder 5 into the thrown-on position 8 and the thrown-off position 7. At its center point 18, the planetary wheel 34 is mounted eccentrically on the stationary pivot point 20 via the pivoting lever 19 which is configured, for example, to be rectilinear.

The transfer cylinder 5 is mounted in an eccentric bearing ring 21 (only represented schematically as an arrow), a connecting element 22 being arranged fixedly on the bearing ring 21.

A connecting rod of the linkage 17 is movably mounted between the connecting element 22 and the pivoting lever 19 on articulation points 24; 25.

The pivot point 20 corresponds to the center point of the central wheel 33 in the exemplary embodiment described.

In the thrown-on position 8, all the cylinders 3 to 6 are driven, starting from the first intermediate wheel 13, exclusively via the cylinder drive wheels 9 to 12, while no force is transmitted between the cylinder drive wheels 10; 11 of the two transfer cylinders 5; 6 in the thrown-off position 7, and the left-hand pair of impression cylinders 1 can be rotated via the gear-wheel chain 16, for example in order to change a plate and/or rubber blanket.

Between the gear wheel 35 and the planetary wheel 34 there is tooth play in the thrown-on position 8, that is to say when all the impression cylinders 3 to 6 are driven exclusively via the cylinder drive wheels 9 to 12, or engagement of the gear wheels 34; 35 is configured with play, with the result that the tooth flanks of the planetary wheel 34 and of the gear wheel 35 do not rest on one another. Thus, no force is transmitted between the planetary wheel 34 and the gear wheel 35, as a result of which no force is transmitted from the gear wheel 35 to the intermediate wheel 15 engaging with it either. Thus, no force is transmitted between the cylinder drive wheel 12 and the intermediate wheel 15, and there is therefore no wear, on account of the flank contact between the planetary wheel 34 and the gear wheel 35 being interrupted in the thrown-on position.

As an alternative, it is also possible to configure the central wheel 33 instead of the planetary wheel 34 with tooth play as explained above. In this case, the tooth play exists between the central wheel 33 and the planetary wheel 34, the planetary wheel 34 always being in exact flank contact with the gear wheel 35. Thus, in the thrown-on position, the transmission of force between the gear wheels 33; 34 is stopped by means of interrupting the flank contact.

If the transfer cylinder 5 is pivoted into the thrown-off position 7, the planetary wheel 34 is automatically pivoted synchronously with it by the linkage 17.

When the transfer cylinder 5 is pivoted into the thrown-off position 7, the control gear 31 rotates the eccentric bearing ring 21 of the transfer cylinder 5. During this rotation of the bearing ring 21, the cylinder drive wheel 11 of the transfer cylinder 5 is rotated while rolling on the cylinder drive wheel 12 of the forme cylinder 3. Thus, rotation or pivoting of the transfer cylinder 5 or of the cylinder drive wheel 11 takes place within the toothing of the cylinder drive wheels 11; 12. At the same time, the planetary wheel 34 is pivoted by the linkage 17 connected to the bearing ring 21, the planetary wheel 34 being rotated on the central wheel 33 or between the central wheel 33 and the gear wheel 35. Thus, in this case as well, this rotation of the planetary wheel 34 takes place within the toothing of the gear wheels 33; 34; 35 of the planetary gear mechanism 36.

It is significant that, by means of this planetary wheel 34 which can be pivoted synchronously with the transfer cylinder 5, a movement is produced which turns in the opposite direction to the turning of the transfer cylinder 5 or to the turning of the cylinder drive wheel 11, in order that the cylinder drive wheels 10; 11, mutually meshing in the thrown-on position 8, of the two transfer cylinders 5; 6 can disengage when the transfer cylinder 5 is being pivoted into the thrown-off position 7, and thus only after this is the pivoting of the transfer cylinder 5 into the thrown-off position 7 made possible.

The counter-rotational movement has the effect that the mutually meshing cylinder drive wheels 10; 11 do not build up tension between them when the transfer cylinder 5 is being pivoted, but rather the tooth flanks of the cylinder drive wheels 10; 11 lie movably, i.e. without mutual tensioning, against one another within the toothing until the meshing is finally interrupted.

An important aspect during this is that the printing gap S can be larger than the tooth height of the individual cylinder drive wheels 10; 11 and thus the toothing is completely disengaged in the printing gap position S between the cylinder drive wheels 10; 11 for the purpose of throwing off 7.

Advantageously, the drive according to the present invention should already be used when the printing gap S is larger than 25% of the tooth height of the cylinder drive wheels 10; 11 which can be moved apart from one another into the thrown-off position 7.

During the pivoting of the planetary wheel 34, its tooth flanks engage with the gear wheel 35, i.e. the tooth flanks of the planetary wheel 34 and of the gear wheel 35 rest on one another, the intermediate wheel 15 being driven via the gear wheel 35, and force is thus transmitted between the cylinder drive wheel 12 and the intermediate wheel 15.

During the pivoting of the transfer cylinder 5 and planetary wheel 34, the engaged cylinder drive wheels 10; 11 are simultaneously separated.

In the process, the drive is changed both from the cylinder drive wheels 10; 11 of the transfer cylinders 5; 6 to the intermediate wheels 13 to 15 when the transfer cylinder 5 is pivoted into the thrown-off position 7, and also from the intermediate wheels 13 to 15 to the cylinder drive wheels 10; 11 when the transfer cylinder 5 is pivoted back into the thrown-on position 8, in each case without briefly simultaneous tooth engagement of the cylinder drive wheels 10; 12 with the intermediate wheels 13; 15 when the transfer cylinder 5 and the intermediate wheel 15 are pivoted jointly.

Thus, it is not necessary either to correct the circumferential register in the case of the cylinder drive wheels 10; 11 engaging again or re-engaging, as it is possible to preclude mutual rotation of the ring gears 12; 15 and thus a change in the peripheral register of the forme cylinder 3.

The present invention can also be used in the way described for a printing unit which is equipped with only three impression cylinders. Here, ink is applied by the left-hand pair of impression cylinders 1 only to the left-hand side of the printing-material web, while the right-hand transfer cylinder 6 acts as an impression cylinder 28 with the forme cylinder 4 cooperating with it being omitted.

The impression cylinder 6; 28 can also be driven in a manner separated from the gear wheel 13 at a separate location on the cylinder drive wheel 10 of the impression cylinder, as indicated by an additional gear wheel 29 represented in FIG. 1 by a dash-dotted line. As an alternative, the cylinder drive wheel 10 or the cylinder drive wheel 9 can be directly connected to a drive (not shown in greater detail).

As an alternative, the pivoting movements of the transfer cylinder 5 and of the planetary wheel 34 can be carried out by means of a drive 30, for example a pressure-medium-operated operating cylinder, which is pivotably attached to the frame and acts on the linkage 17.

In a manner not shown in greater detail, the linkage 17 can alternatively: be configured with a rack, by means of which the transfer cylinder 5 and the planetary wheel 34 are connected or coupled.

The invention is not intended to be restricted only to the use of a linkage. Any mechanism or apparatus serving to coordinate the synchronous pivoting of transfer cylinder 5 and planetary wheel 34 can be used, for example, a control gear.

It is also possible for the throwing-off movement 7 of the transfer cylinder 5 to be registered electrically in an equivalent manner and forwarded to a control gear which displaces the planetary wheel 34 synchronously with the throwing-off movement 7 of the transfer cylinder 5. Computing and/or memory devices can be used here, by means of which the throwing-off movement 7 of the transfer cylinder 5 is converted by calculation into the displacement movement, synchronous with it, of the planetary wheel 34, or by means of which the said synchronous displacement movement of the planetary wheel 34 is controlled.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. Apparatus for disengaging the drive wheel of a transfer cylinder from the drive wheel of an impression cylinder, said drive wheel of said transfer cylinder engaging said drive wheel of said impression cylinder when said transfer cylinder is in a thrown-on position, said drive wheel of said transfer cylinder further engaging a drive wheel of a forme cylinder, said apparatus comprising:

a gear wheel chain which meshes with the drive wheels of the forme cylinder and the impression cylinder, means for pivoting said transfer cylinder to a thrown-off position wherein said drive wheel of said transfer cylinder is disengaged from said drive wheel of said impression cylinder, and a transfer element connected to said transfer cylinder and to said gear wheel chain so that said gear wheel chain produces a counter-rotation in said transfer cylinder synchronously with the pivoting of said transfer cylinder, said counter-rotation being opposite to said pivoting, whereby, the drive wheel of the transfer cylinder can disengage the drive wheel of the impression cylinder without increasing tension on gear teeth of the respective drive wheels.

2. An apparatus as in claim 1 wherein said gear wheel chain comprises at least one planetary wheel, said transfer element causing said at least one planetary wheel to pivot synchronously with the pivoting of the transfer cylinder.

3. An apparatus as in claim 1 wherein said transfer element comprises one of a linkage, a drive, a control gear, and an electrical apparatus.

4. An apparatus as in claim 1 further comprising an eccentric bearing ring on said transfer cylinder and a pivoting lever carrying said planetary wheel, said transfer element being arranged on said bearing ring and on said pivoting lever.

5. An apparatus as in claim 1 further comprising a control gear which actuates said transfer element 6. An apparatus as in claim 1 further comprising a drive which actuates said actuating element, said drive being pivotably attached to a frame.

6. An apparatus as in claim 1 further comprising a drive which actuates said actuating element, said drive being pivotably attached to a frame.

7. An apparatus as in claim 1 wherein said gear wheel chain comprises an intermediate wheel which is in permanent drive connection with the drive wheel of the impression cylinder.

8. An apparatus as in claim 1 wherein said transfer cylinder and said forme cylinder form a first ink-transferring pair of cylinders, said apparatus further comprising a forme cylinder which cooperates with said impression cylinder to form a second ink transferring pair of cylinders.

9. An apparatus as in claim 2 wherein said gear wheel chain comprises a central wheel and an outer wheel driven by said central wheel via said planetary wheel, said planetary wheel engaging at least one of said central wheel and said outer wheel without flank contact when said transfer cylinder is in the thrown-on position.

10. An apparatus as in claim 1 wherein the drive wheels of the transfer cylinder and the impression cylinder have teeth with a tooth height, the transfer cylinder and the impression cylinder in the thrown-off position being separated by a printing gap which is at least 25% larger than the tooth height.

11. An apparatus as in claim 2 wherein said gear wheel chain has an overall gear ratio which cannot be changed by said planetary wheel.

12. Apparatus as in claim 1 wherein said gear wheel chain comprises a drive wheel of an additional form cylinder which engages said drive wheel of said impression cylinder.

* * * * *